US007086314B2

(12) United States Patent
Wannop

(10) Patent No.: US 7,086,314 B2
(45) **Date of Patent: *Aug. 8, 2006**

(54) AUTOMATIC BIT CHANGING SCREWDRIVER

(75) Inventor: George Michael Wannop, Kelowna (CA)

(73) Assignee: FutureWorks Concepts Ltd., Kelowna (CA)

( * ) Notice: Subject to any disclaimer, the term of this patent is extended or adjusted under 35 U.S.C. 154(b) by 0 days.

This patent is subject to a terminal disclaimer.

(21) Appl. No.: 10/607,969

(22) Filed: Jun. 30, 2003

(65) Prior Publication Data

US 2004/0065177 A1 Apr. 8, 2004

Related U.S. Application Data

(63) Continuation-in-part of application No. 09/837,458, filed on Apr. 19, 2001, now Pat. No. 6,601,483.

(51) Int. Cl.
*B25G 1/08* (2006.01)

(52) U.S. Cl. ..... 81/490; 81/439

(58) Field of Classification Search ..... 81/490, 81/438–440, 177.4; 7/165, 167
See application file for complete search history.

(56) References Cited

U.S. PATENT DOCUMENTS

| | | | | |
|---|---|---|---|---|
| 5,673,600 | A * | 10/1997 | Yanagi et al. | 81/490 |
| 6,205,893 | B1 * | 3/2001 | Sato | 81/439 |
| 6,332,384 | B1 * | 12/2001 | Cluthe | 81/490 |
| 6,502,484 | B1 * | 1/2003 | Pao-Hsi | 81/439 |
| 6,601,483 | B1 * | 8/2003 | Wannop | 81/490 |
| 2002/0007705 | A1 * | 1/2002 | Beauchamp | 81/490 |
| 2003/0084758 | A1 * | 5/2003 | Chiang | 81/490 |

* cited by examiner

*Primary Examiner*—David B. Thomas
(74) *Attorney, Agent, or Firm*—Antony C. Edwards

(57) ABSTRACT

A screwdriver with a bit storage member rotatable about a slotted, apertured core. A magnet-tipped push rod slides through the core. A magnetic lever arm is pivotally coupled to the core and biased toward its slot. The rod moves through the member between extended and retracted positions. In the extended position, the core is rotatable with respect to the member to position the slot adjacent a bit storage cavity; and, the lever arm is pivotally biased toward and through the slot, magnetically attracting the tool bit in the cavity. While the rod moves into the retracted position, the member is not rotatable about the core; the rod pushes the arm and bit away from the cavity, through the slot into the core; the rod's magnet moves forwardly magnetically attracting the bit; and, pushes the bit forwardly through a shaft to protrude through the shaft's open forward end.

50 Claims, 6 Drawing Sheets

AUTOMATIC BIT CHANGING SCREWDRIVER

CROSS REFERENCE TO RELATED APPLICATION

This application is a Continuation-in-Part of U.S. patent application Ser. No. 09/837,458 filed Apr. 19, 2001, now U.S. Pat. No. 6,601,483, entitled Automatic Bit Changing Screwdriver.

TECHNICAL FIELD

This invention pertains to a multiple bit screwdriver which can be actuated to withdraw a bit from the screwdriver's chuck, return that bit to a revolver style magazine, select a different bit from the magazine, and feed the selected bit into the chuck.

BACKGROUND

The prior art has evolved a wide variety of multiple bit screwdrivers, some of which incorporate mechanisms for loading bits from a bit storage magazine directly into the screwdriver's chuck and for removing bits from the chuck and returning them to the magazine. For example, U.S. Pat. No. 1,579,498 Anderson, issued 6 Apr. 1926 provides a screwdriver type tool in which the bit storage magazine comprises a plurality of chambers spaced radially around the inner circumference of the screwdriver's handle. A cap on the end of the handle is rotated into alignment with a selected bit chamber. A "plunger pin" is then withdrawn through the cap, allowing the selected bit to drop into the space previously occupied by the plunger pin. The plunger pin is then pushed back through the cap, to force the selected bit through an apertured shaft which protrudes from the handles opposite end, until the tip of the bit extends through the bit chuck at the shaft's outward end.

Anderson's device has some disadvantages. For example, Anderson's device relies upon the force of gravity to move a bit from its storage chamber into the space evacuated by the plunger pin; or, to return a bit to an empty storage chamber. The force of gravity is also used to remove a bit from the chuck (i.e. the tool is held vertically and the plunger pin withdrawn, allowing the bit to fall out of the chuck and drop through the shaft into the space evacuated by the plunger pin). It is accordingly necessary for the user to orient and manipulate the tool between various horizontal and vertical positions in order to properly exploit the force of gravity as bits are loaded and unloaded. The present invention overcomes these disadvantages.

SUMMARY OF THE INVENTION

The invention provides, in one embodiment, a screwdriver having telescopically slidable inner and outer sleeves which form a bit storage member and a hand grip respectively. A plurality of bit storage cavities are formed around the inner circumference of the inner sleeve, such that a tool bit can be stored in each cavity. An apertured core extends longitudinally into the inner sleeve, and is coupled to a base portion which extends into and is slidably supported by the outer sleeve. An apertured shaft extends from the core's forward end in coaxial alignment with the core's aperture. The rearward end of a push rod is fastened to the outer sleeve's rearward end, such that the push rod can be pushed longitudinally and coaxially through the inner sleeve, core and shaft. In one embodiment, a magnet is supported on the push rod's forward end. It is also contemplated that the push rod itself could be magnetized or that other means for magnetically attracting be employed so that the forward end of the push rod will magnetically couple to a metal tool bit. The core has a forwardly projecting and apertured stem in which a bit changing slot is provided. A lever arm, which in one embodiment may be magnetic, is coupled to the core and biased toward the bit changing slot. The push rod is slidably movable through the core and inner sleeve between extended and retracted positions.

When the push rod is in the extended position, the push rod means for magnetically attracting is located rearwardly of the bit storage cavities; the core can be rotated with respect to the inner sleeve to position the bit changing slot adjacent a selected bit storage cavity; and, the lever arm is pivotally biased toward and through the bit changing slot, for example magnetically attracting, or for example mechanically releasably mounting or coupling by a coupling or a mounting means, to the lever arm a tool bit located in the selected bit storage cavity. As the push rod is moved from the extended position into the retracted position, it initially pushes the lever arm and the tool bit away from the selected bit storage cavity, through the bit changing slot and into the core. The push rod's forward end is then pushed forwardly toward the rearward end of the tool bit, magnetically attracting the tool bit onto the push rod. The push rod is then pushed through the core and shaft, pushing the tool bit forwardly through the core and shaft until the tool bit protrudes through the shaft's open forward end. The shaft may be non-rotatably retained on the forward end of the inner sleeve or may be rotatably retained thereon, for example with a reversible one-way ratchet.

During movement of the push rod from the retracted position into the extended position, the push rod magnetically retains the tool bit on the forward end of the push rod as the push rod is pulled rearwardly, thereby pulling the tool bit rearwardly through the shaft and the core's stem to position the tool bit adjacent the bit changing slot and the selected one of the bit storage cavities. A first spring is coupled between the lever arm and the core to bias the lever arm toward and through the bit changing slot. Movement of the push rod from the extended position into the retracted position pushes the forward end of the push rod against the lever arm, overcoming the first spring's bias. Movement of the outer sleeve from the retracted position into the extended position withdraws the push rod from the lever arm, whereupon the first spring biases the lever arm toward and through the bit changing slot, sweeping the tool bit back into its bit storage cavity.

A first plurality of longitudinally extending ridges and grooves can be alternately interleaved on the inner sleeve's outer surface. A second plurality of longitudinally extending ridges and grooves can be alternately interleaved on the outer sleeve's inner surface. The first plurality ridges are sized and shaped for slidable longitudinal movement along the second plurality grooves; and, the second plurality ridges are sized and shaped for slidable longitudinal movement along the first plurality grooves. A third plurality of longitudinally extending ridges and grooves can be alternately interleaved on the base portion's outer surface. The third plurality ridges are sized and shaped for slidable longitudinal movement along the second plurality grooves; and, the second plurality ridges are sized and shaped for slidable longitudinal movement along the third plurality grooves. The ridges and grooves are mutually aligned such that when-ever the outer sleeve is telescopically slidably movable with respect to the inner sleeve, the bit changing slot is aligned with one of the bit storage cavities.

DETAILED DESCRIPTION OF EMBODIMENTS OF THE INVENTION

Figure 1:
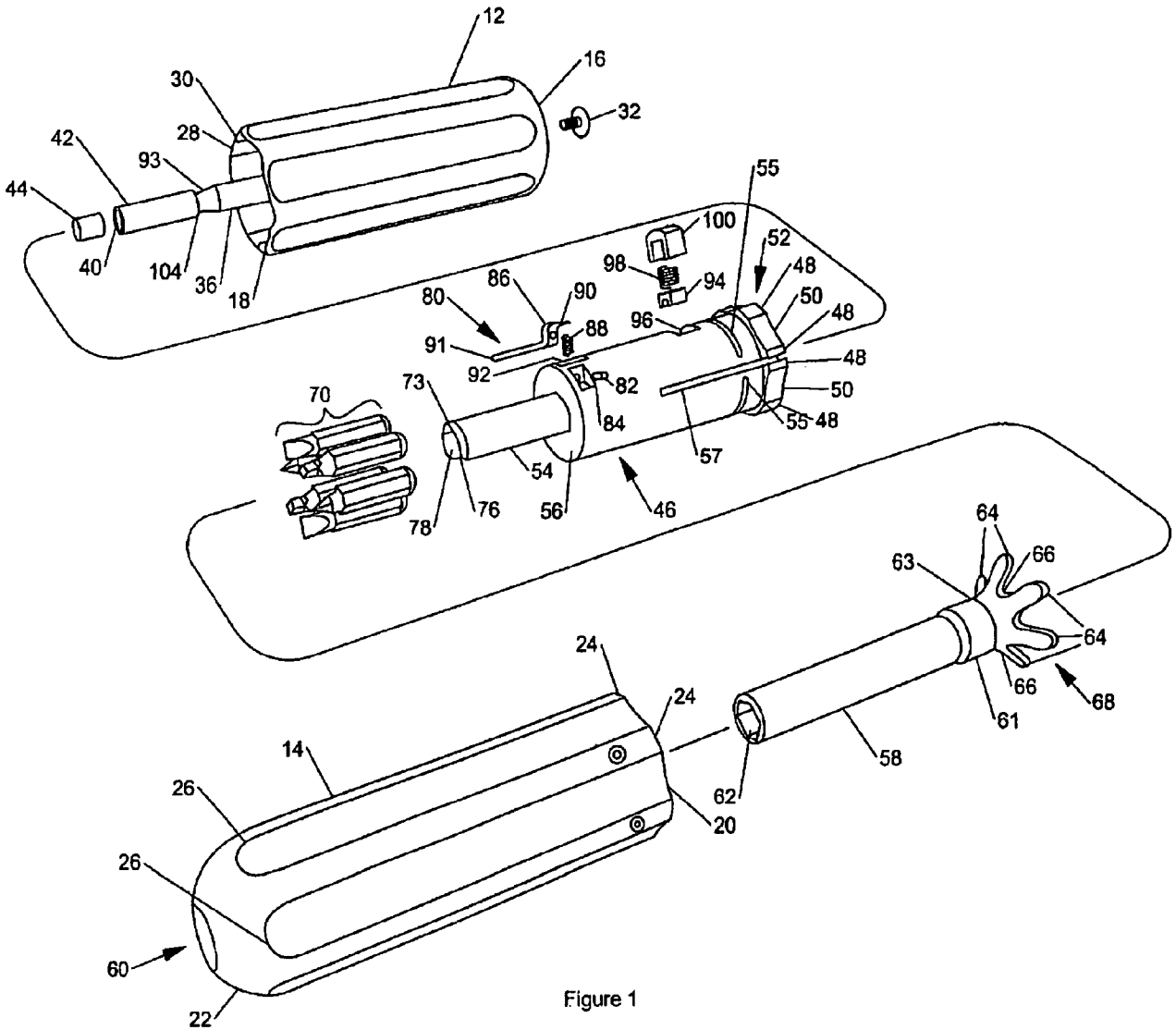
FIG. 1 is an exploded pictorial illustration of a screwdriver in accordance with one embodiment of the invention.

Screwdriver 10 (FIGS. 1–5) incorporates hollow outer and inner sleeves 12, 14 which form a hand grip and a bit storage member respectively. The inside diameter of outer sleeve 12 is slightly greater than the outside diameter of inner sleeve 14 to allow sleeves 12, 14 to telescopically reciprocate with respect to one another as hereinafter explained. Outer sleeve 12 has a closed rearward (i.e. rightward, as viewed in FIGS. 1–3) end 16 and an open forward (i.e. leftward, as viewed in FIGS. 1–3) end 18. Inner sleeve 14 has an open rearward end 20 and an apertured, forward end 22. A plurality of longitudinally extending ridges 24 and grooves 26 are alternately interleaved on the outer surface of inner sleeve 14. An equal plurality of longitudinally extending ridges 28 and grooves 30 are alternately interleaved on the inner surface of outer sleeve 12. Ridges 24 are sized and shaped for smooth slidable longitudinal movement along grooves 30; and, ridges 28 are sized and shaped for smooth slidable longitudinal movement along grooves 26.

Screw 32 releasably fastens rearward end 34 of push rod 36 to the central, inner and forward face of outer sleeve 12's rearward end 16. Push rod 36 extends longitudinally and coaxially through coaxially aligned sleeves 12, 14. A cylindrical cavity 40 having an open forward end is formed in the forward end 42 of push rod 36. Push rod magnet 44 is glued or press-fitted within cavity 40.

Figure 3:
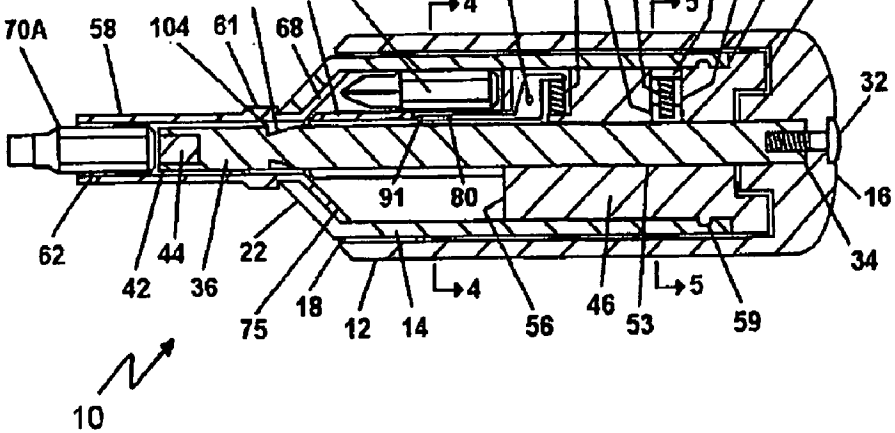
FIG. 3 is a cross-sectional side elevation view of the FIG. 1 screwdriver in its assembled configuration, showing the inner sleeve telescopically retracted within the outer sleeve, and showing a bit positioned for use in the chuck.
Figure 2:
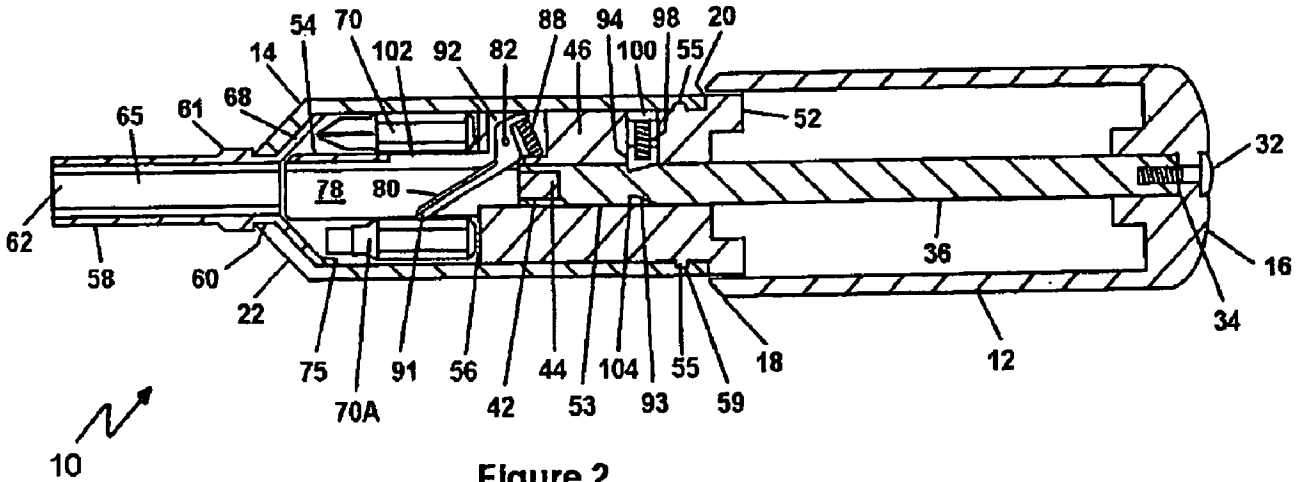
FIG. 2 is a cross-sectional side elevation view of the FIG. 1 screwdriver in its assembled configuration, showing the outer sleeve telescopically extended away from the inner sleeve, and showing a bit being returned to a bit storage cavity.

A selector core 46 is mounted within inner sleeve 14. A plurality of short, longitudinally extending ridges 48 and grooves 50 are alternately interleaved around the circumference of a radially outwardly extending rearward base portion 52 of selector core 46. Ridges 48 and grooves 50 are sized and shaped for slidable longitudinal movement along grooves 30 and ridges 28 respectively on the inner surface of outer sleeve 12. Slot 57 longitudinally bisects and imparts a spring bias characteristic to approximately the rearward half of selector core 46. A pair of circumferentially and outwardly extending ridges 55 are formed on selector core 46 forwardly of base portion 52, one such ridge on either side of slot 57. A mating circumferential groove 59 is formed around the inner surface of inner sleeve 14, forwardly of rearward end 20. During assembly of screwdriver 10, selector core 46 is slidably inserted through open rearward end 20 of inner sleeve 14. Slot 57 allows the rearward halves of selector core 46 to be compressed toward one another, thus compressing ridges 55 radially inwardly such that those ridges can pass through open rearward end 20 of inner sleeve 14. When the compression force is removed, the aforementioned spring bias characteristic urges the bisected rearward halves of selector core 46 apart, seating ridges 55 in groove 59. Selector core 46 is thereby removably and rotatably retained within inner sleeve 14. A (preferably hexagonally) apertured stem 54 extends forwardly from the central, forward face 56 of selector core 46 in coaxial alignment with cylindrical aperture 53 which extends longitudinally through selector core 46. Push rod 36 extends through aperture 53 and stem 54, as seen in FIGS. 2 and 3, inhibiting compression of selector core 46 with respect to slot 57, thereby preventing dislodgement of selector core 46 from within inner sleeve 14.

A (preferably hexagonally) apertured steel shaft 58 extends through aperture 60 in forward end 22 of inner sleeve 14. The forward (and also preferably hexagonally apertured) end of shaft 58 constitutes a tool bit holding chuck 62. A plurality of radially spaced, outwardly protruding ridges 64 alternately interleaved with grooves 66 are provided on the rearward base 68 of shaft 58. Ridges 64 and grooves 66 are sized and shaped to mate within grooves 74 and ridges 72 (FIG. 4) respectively formed on the inner surface of inner sleeve 14. During assembly of screwdriver 10, and before insertion of selector core 46 into inner sleeve 14 as aforesaid, shaft 58 is slidably inserted through inner sleeve 14 and through aperture 60, until the forward face of base 68 reaches the inner and rearward face of inner sleeve 14's forward end 22. Shaft 58 is then tugged forwardly while inner sleeve 14 is simultaneously tugged rearwardly. Such tugging draws shaft 58's tapered collar 61 through aperture 60 and seats the rearward face of collar flange 63 firmly against the rearward face of forward end 22 of inner sleeve 14, as seen in FIGS. 2 and 3. Ridges 64 and grooves 66 remain engaged within inner sleeve 14's grooves 74 and ridges 72, providing torsional resistance to twisting forces imparted to shaft 58 and inner sleeve 14 during normal screwdriving operation of screwdriver 10. The forward rim 73 of stem 54 is tapered; and, the rearward face 75 (FIGS. 2 and 3) of shaft 58's base 68 is inwardly and forwardly sloped or tapered such that when selector core 46 is inserted within inner sleeve 14 as aforesaid, rim 73 butts gently against and is self-centered within face 75. This self-centering action maintains coaxial alignment of stem 54 and shaft 58 by resisting off-axis dislodgement of stem 54 due to forces imparted thereto during bit-changing operation of screwdriver 10 (i.e. when push rod 36 is withdrawn from shaft 58).

After selector core 46, stem 54 and shaft 58 are assembled within sleeve 14 as aforesaid, selector core base portion 52 protrudes rearwardly from rearward end 20 of inner sleeve 14. Outer sleeve 12 with push rod 36 fastened thereto as aforesaid is then slidably fitted over selector core base portion 52 and inner sleeve 14 by passing push rod 36 through aperture 53 in selector core 46, through coaxially aligned hexagonal aperture 78 in stem 54, and into coaxially aligned hexagonal aperture 65 (best seen in FIG. 2) in shaft 58. When outer sleeve 12's forward end 18 reaches protruding selector core base portion 52, grooves 30 and ridges 28 on sleeve 12's inner surface are aligned with and slidably advanced over ridges 48 and grooves 50 respectively on base portion 52. When sleeve 12's forward end 18 reaches rearward end 20 of inner sleeve 14, grooves 30 and ridges 28 on sleeve 12's inner surface are aligned with and slidably advanced over ridges 24 and grooves 26 respectively on sleeve 14's outer surface.

Stem 54 is formed to align its longitudinally extending hexagonal aperture 78 with ridges 48 and grooves 50 of selector core 46's base 52. Shaft 58 is formed to align its longitudinally extending hexagonal aperture 65 with ridges 64 and grooves 66 of shaft 58's base 68. When screwdriver 10 is assembled as aforesaid, the ridges and grooves on sleeves 12, 14 and on selector core base 52 are aligned such that hexagonal apertures 65, 78 are hexagonally aligned with one another to facilitate smooth passage of a hexagonally cross-sectioned tool bit there-along, as hereinafter explained.

Figure 4:
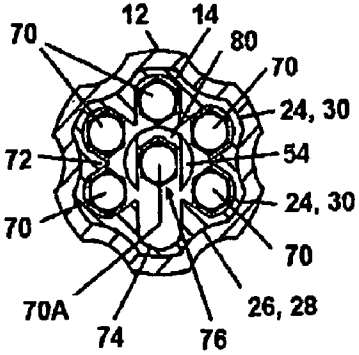
FIG. 4 is a cross-sectional view taken with respect to line 4—4 shown in FIG. 3.

A plurality of preferably hexagonally cross-sectioned tool bits 70 are provided within the forward portion of inner sleeve 14, forwardly of selector core 46's forward face 56, which serves as a rearward base support for each of tool bits 70. As best seen in FIG. 4, one tool bit 70 can be stored within each groove 74. Accordingly, inner sleeve 14 constitutes a "bit storage member", with each one of grooves 74 constituting an individual bit storage cavity.

A rotatably positionable bit changing slot 76 extends longitudinally along stem 54 to allow a selected one (70A) of tool bits 70 to be moved from one of grooves 74 through slot 76 into stem 54's hexagonal aperture 78, as hereinafter explained. The non-slotted portion of stem 54 maintains the non-selected tool bits in their respective grooves 74 in position for eventual alignment with bit changing slot 76 as it is rotatably positioned. A magnetic "bit changing" lever arm 80 is pivotally coupled to selector core 46 by pivot pin 82, which extends through aperture 84 in selector core 46 and through aperture 86 in lever arm 80. First spring 88 extends between lever arm 80's rearward end 90 and a wall portion of selector core 46 within recess 92, as best seen in FIG. 2. Recess 92 is apertured, forwardly of its aforementioned wall portion, to communicate with stem 54's aperture 78; and, lever arm 80 has an inwardly stepped shape. This facilitates insertion of lever arm 80's forward end 91 through recess 92 into stem 54's aperture 78, prior to insertion of pivot pin 82 through apertures 84, 86. First spring 88 biases lever arm 80's forward end 91 toward and through bit changing slot 76, as shown in FIG. 2.

A forwardly tapered region 93 circumferentially surrounds a central forward portion of push rod 36. A stop member 94 having a correspondingly tapered inward face is mounted within a second, rearward, recess 96 in selector core 46. A second spring 98 is held against the outward face of stop member 94 and protected by "U" shaped retainer 100. Second spring 98 biases stop member 94 radially inwardly toward push rod 36. The outward surface of retainer 100 is sized and shaped to accommodate slidable displacement of retainer 100 with respect to one of grooves 74 on the inner surface of inner sleeve 14, as hereinafter explained.

In operation, assuming screwdriver 10 is in the assembled, retracted position depicted in FIG. 3, the user grasps shaft 58 with one hand and grasps outer sleeve 12 with the other hand. Outer sleeve 12 is then pulled rearwardly into the extended position shown in FIG. 2, in which push rod 36's tapered region 93 is adjacent second recess 96, whereupon second spring 98 urges stop member 94 radially inwardly into tapered region 93. The radially protruding rim 104 at the forward end of tapered region 93 contacts stop member 94, preventing further rearward movement of push rod 36 or outer sleeve 12. This pulling action also withdraws push rod 36 rearwardly, through shaft 58 and stem 54, leaving push rod magnet 44 positioned rearwardly of selector core 46's forward face 56, as seen in FIG. 2; and, positions outer sleeve 12's forward end 18 rearwardly of inner sleeve 14's rearward end 20, allowing coaxial rotation of sleeves 12, 14 with respect to one another. As sleeves 12, 14 are rotated to select a bit, lever arm 80's inwardly biased forward end 91 rotates and moves radially inwardly and outwardly as end 91 encounters tool bits 70.

As previously explained, ridges 48 and grooves 50 on selector core 46's base 52 are slidably received within grooves 30 and ridges 28 respectively on the inner surface of outer sleeve 12. Accordingly, rotation of outer sleeve 12 with respect to inner sleeve 14 simultaneously rotates selector core 46 and stem 54, allowing bit changing slot 76 to be indexed into position adjacent any selected one of grooves 74 (i.e. bit storage cavities) on the inner surface of inner sleeve 14. Alternatively, bit changing slot 76 can be indexed into position adjacent one of grooves 74 by rotating inner sleeve 14 with respect to outer sleeve 12, selector core 46, stem 54 and bit changing slot 76. Whenever bit changing slot 76 is indexed into position adjacent one of grooves 74, second spring 98 urges retainer 100 radially outwardly into a corresponding one of sleeve 14's grooves 74, producing a "click" sound and providing tactile feedback to indicate to the user that sleeve 12 is oriented such that it can be slidably advanced over inner sleeve 14 to retrieve a bit from one of bit storage cavity grooves 74. Such orientation can be indicated to the user by providing suitable markings on either or both of sleeves 12, 14; thereby allowing the user to select a particular one of bits 70 stored within one of grooves 74 (i.e. bit 70A as shown in FIG. 2). Such selection can be further facilitated by forming inner sleeve 14 of a transparent plastic material. The above-described alignment of the ridges and grooves on sleeves 12, 14 and on selector core base 52 ensures that whenever outer sleeve 12 is oriented such that it can be slidably advanced over inner sleeve 14, bit changing slot 76 is aligned for positioning adjacent one of bit storage cavity grooves 74 and retrieval of a bit therefrom.

As was also previously explained, first spring 88 biases magnetic lever arm 80's forward end 91 toward and through bit changing slot 76, as seen in FIG. 2. When bit changing slot 76 is positioned as aforesaid adjacent a selected one of grooves 74, the central portion of bit 70A is magnetically attracted to lever arm 80's forward end 91. The user pushes outer sleeve 12 forwardly over inner sleeve 14, slidably engaging sleeve 12's inner surface ridges 28 and grooves 30 within sleeve 14's outer surface grooves 26 and ridges 24 respectively, and returning sleeves 12, 14 to their relative positions shown in FIG. 3. This action initially pushes push rod 36's tapered region 93 forwardly over stop member 94, overcoming the inward biasing action of second spring 98 and moving stop member 94 radially outwardly away from push rod 36. Further forward pushing of sleeve 12 over sleeve 14 pushes push rod 36's forward end against lever arm 80, overcoming the basing action of first spring 88 and moving lever arm 80 radially outwardly away from push rod 36. Bit 70A remains magnetically attracted to lever arm 80's forward end 91 and is drawn radially inwardly out of groove 74, through bit changing slot 76 and into stem 54's aperture 78. Still further forward pushing of sleeve 12 over sleeve 14 positions push rod magnet 44 adjacent the rearward end of bit 70A, once bit 70A has been drawn into aperture 78 as aforesaid. Push rod magnet 44 magnetically attracts the rearward end of bit 70A, positioning tool bit 70A on and in coaxial alignment with push rod 36. The above-described two stage process of magnetically attracting bit 70A (i.e. the first stage attraction performed by magnetic lever arm 80, and the second stage attraction performed by push rod magnet 44) minimizes the likelihood of non-coaxial alignment of bit 70A with push rod 36, which could result in jamming of bit 70A during further forward pushing of sleeve 12 over sleeve 14. Such magnetic attraction also avoids the need for specialized bits, such as circumferentially notched bits, as are required by some prior art bit changing mechanisms.

Figure 1A:
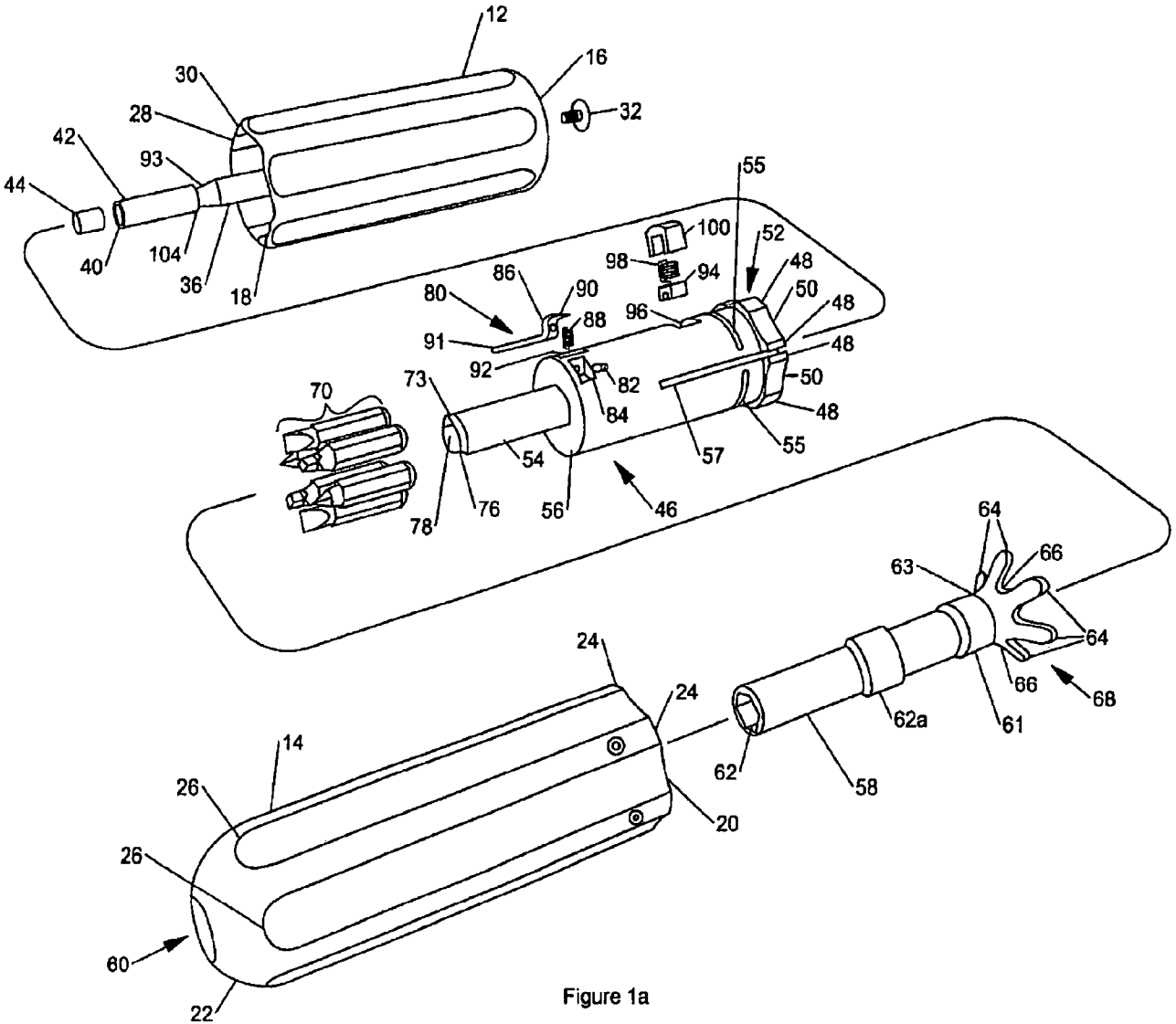
FIG. 1*a* is an exploded pictorial illustration of a screwdriver in accordance with a further embodiment of the invention.
Figure 5:
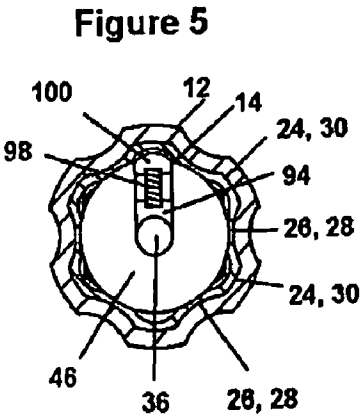
FIG. 5 is a cross-sectional view taken with respect to line 5—5 shown in FIG. 3.

As outer sleeve 12 is further forwardly advanced over inner sleeve 14, push rod 36 pushes bit 70A (which push rod magnet 44 magnetically retains on push rod 36's forward end) through coaxially aligned apertures 78, 65 in stem 54 and shaft 58 respectively, until bit 70A is non-rotatably positioned in chuck 62 at the forward end of shaft 58, as shown in FIG. 3. The extended longitudinal contact between the ridges and grooves on sleeves 12, 14 when inner sleeve 14 is telescopically retracted within outer sleeve 12; and, the aforementioned engagement of ridges 64 and grooves 66 within inner sleeve 14's grooves 74 and ridges 72, provides solid support for imparting twisting and/or driving forces to bit 70A as sleeves 12, 14, push rod 36 and shaft 58 are coaxially rotated during normal screw-driving operation of screwdriver 10. Moreover, when screwdriver 10 is in the operating state depicted in FIG. 3, outer sleeve 12's inner surface ridges 28 and grooves 30 remain engaged within inner sleeve 14's outer surface grooves 26 and ridges 24 respectively, preventing rotation of sleeves 12, 14 relative to one another, and thereby maintaining alignment of bit changing slot 76 adjacent that one of grooves 74 from which bit 70A was extracted. Chuck 62 is in the embodiment of FIG. 1 non-rotatably mounted to the rearward end of shaft 58. In the alternative embodiment of FIG. 1*a*, chuck 62 is rotatably mounted by reversible one way ratchet mechanism 62*a* onto shaft 58.

When outer sleeve 12 is pulled rearwardly as aforesaid, bit 70A (which push rod magnet 44 magnetically retains on the forward end of push rod 36) is pulled rearwardly through chuck 62, shaft 58 and stem 54. Aperture 53 in selector core 46 is preferably circular in cross-section with a diameter slightly less than the point-to-point diameter across hexagonal aperture 78 in stem 54 (and slightly less than the point-to-point diameter across hexagonal bit 70A). Accordingly, as push rod 36 is pulled rearwardly past the junction of apertures 78, 53 (i.e. at selector core 46's forward face 56) the rearward end of bit 70A is unable to pass into aperture 53. Bit 70A is thus separated from push rod magnet 44 and remains with aperture 78. 15 When push rod 36 reaches the position shown in FIG. 2, first spring 88 urges the rearward end 90 of lever arm 80 radially outwardly with respect to the longitudinal axis of screwdriver 10. Lever arm 80 pivots about pivot pin 82, sweeping the forward end 91 of lever arm 80 radially inwardly and across stem 54's aperture 78 toward and through bit changing slot 76, as seen in FIG. 2. This sweeping action sweeps bit 70A out of aperture 78, through bit changing slot 76 and into the (empty) one of grooves 74 from which the bit was previously extracted as described above. When push rod 36 is pushed forwardly through aperture 53 in selector core 46 as previously explained, the push rod's forward end contacts lever arm 80. Continued forward advancement of push rod 36 causes lever arm 80 to pivot about pivot pin 82, thereby moving the forward end 91 of lever arm 80 toward the inner wall of stem 54 opposite bit changing slot 76, until lever arm 80 reaches its storage position within slot 102 formed on the inner surface of stem 54, as seen in FIG. 3.

Screwdriver 10 can hold as many tool bits as there are grooves 74 (i.e. one bit per groove 74 or bit storage cavity). If desired, a different bit can be substituted for any one of the bits currently stored in any one of grooves 74. This is accomplished by actuating screw-driver 10 as previously explained to load into chuck 62 the bit which is to be replaced. The user then grasps the bit's tip and pulls it forwardly away from push rod magnet 44, removing the bit through the forward end of chuck 62. The base of the substitute bit (not shown) is then inserted rearwardly through chuck 62 until the substitute bit's base is magnetically retained by push rod magnet 44. Screwdriver 10 is then actuated as previously explained to move the substitute bit into that one of grooves 74 previously occupied by the removed bit. If desired, a complete set of replacement bits can quickly be substituted in this fashion, one bit at a time, for the set of bits currently stored in screwdriver 10.

Figure 6:
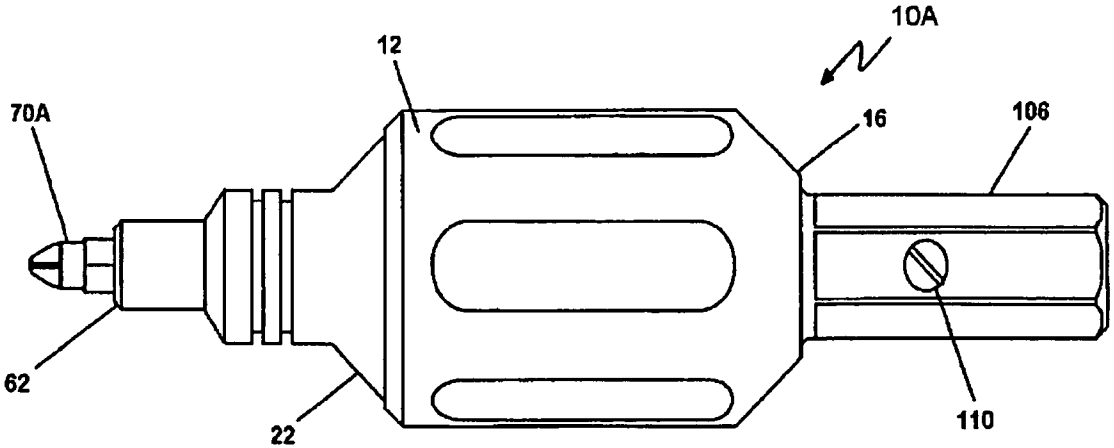
FIG. 6 is a side elevation view of an alternate embodiment of the invention adapted for use with a power drill.
Figure 7:
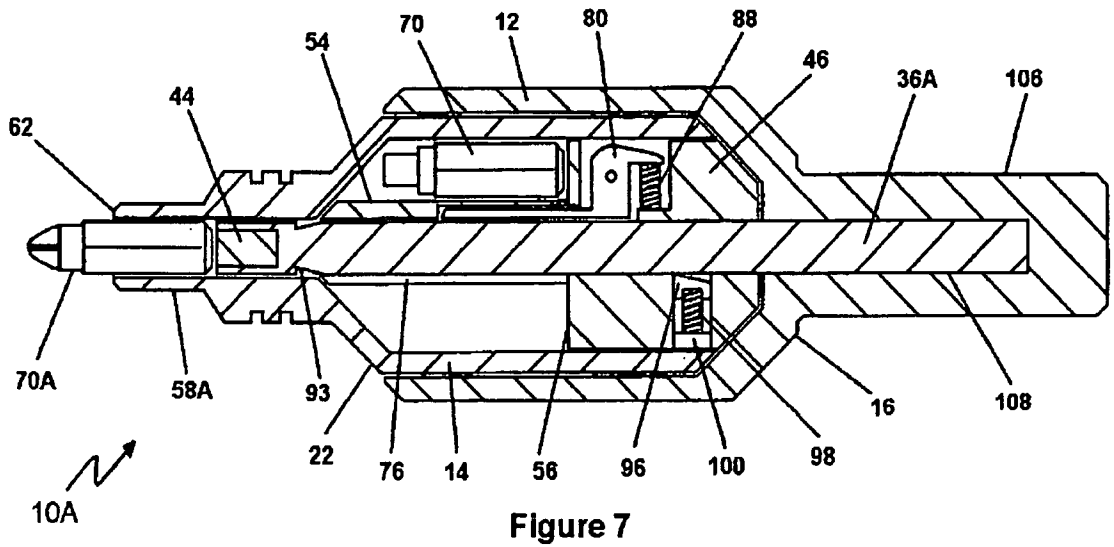
FIG. 7 is a cross-sectional side elevation view of the FIG. 6 embodiment of the invention.

FIGS. 6 and 7 depict an alternate screwdriver 10A adapted for use with a power drill (not shown). Functionally equivalent components which are common to the embodiments of FIGS. 1–5 and FIGS. 6–7 bear the same reference numerals and need not be further described. The suffix "A" is appended to reference numerals designating components of screwdriver 10A which are functionally equivalent to components of screwdriver 10 bearing the same (but non-alphabetically suffixed) reference numerals, but which have a somewhat different structure. For example, screwdriver 10A's shaft 58A is formed integrally with inner sleeve 14, instead of being formed as a separate part, as in the case of screwdriver 10 (persons skilled in the art will appreciate that screwdriver 10's shaft 58 could also be formed integrally with inner sleeve 14). A preferably hexagonally cross-sectioned shank 106 is formed on and protrudes rearwardly from outer sleeve 12's rearward end 16. Push rod 36A extends through sleeve 12's rearward end 16 into cylindrical aperture 108 formed in the forward portion of shank 106. A screw 110 (FIG. 6) is fastened through shank 106 into the rearward end of push rod 36A to prevent separation of push rod 36A from shank 106 during operation. Shank 106 can be removably and tightly fastened within the chuck of a conventional power drill. When the drill is actuated, screwdriver 10A is rotatably driven, thereby imparting a rotational driving force to tool bit 70A.

Figure 8:
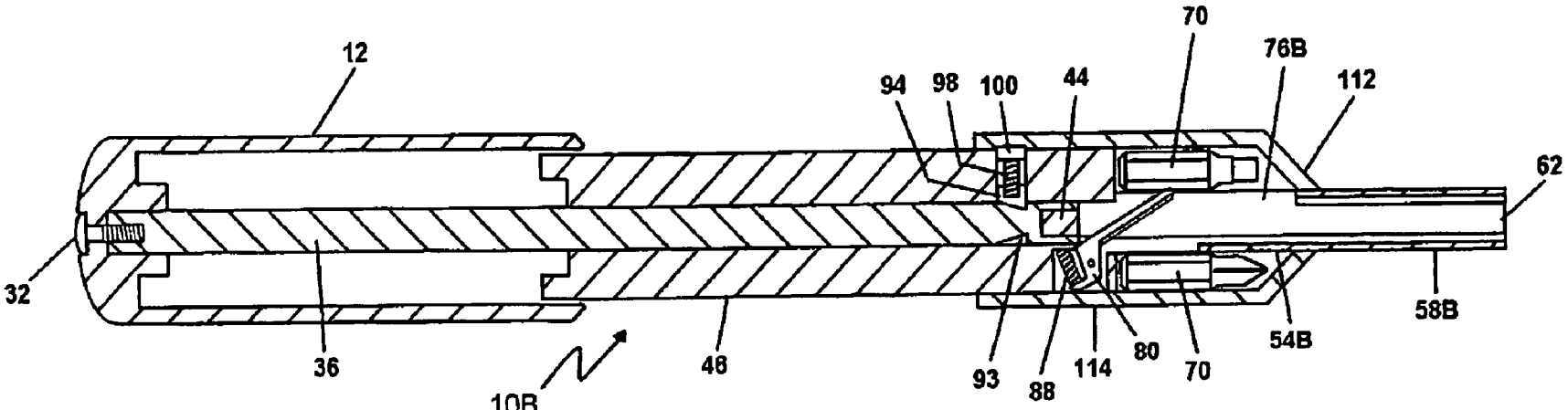
FIG. 8 is a cross-sectional side elevation view of another alternate embodiment of the invention having a removable bit cartridge.
Figure 9:
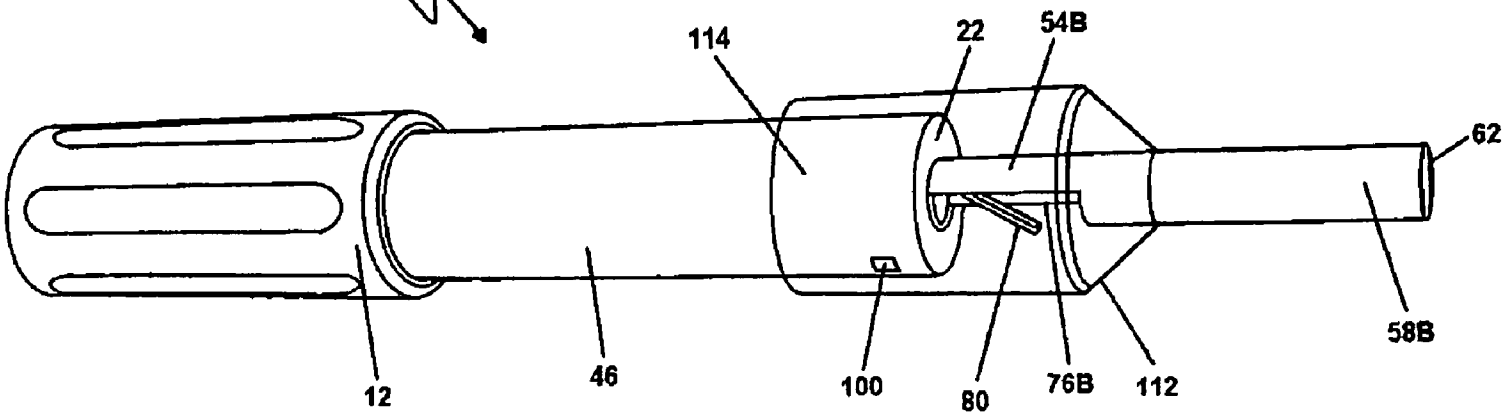
FIG. 9 is a pictorial illustration of the FIG. 8 embodiment of the invention.

FIGS. 8 and 9 depict another alternate screwdriver 10B having a shorter bit storage member 14B, which may be removable. Functionally equivalent components which are common to the embodiments of FIGS. 1–5 and FIGS. 8–9 bear the same reference numerals and need not be further described. The suffix "B" is appended to reference numerals designating components of screwdriver 10B which correspond to components of screwdriver bearing the same non-alphabetically suffixed reference numerals, but have a different structure. Stem 54B and shaft 58B are formed as a single integral shaft. Bit storage member 14B (which may be transparent) has an annular shape such that it may be slidably fitted over shaft 58B and rotated to position a selected bit adjacent bit changing slot 76B. A rearwardly projecting collar 114 portion of bit storage member 14B is rotatably mounted on the forward end of selector core 46. A suitable releasable retaining mechanism such as a quick-disconnect or twist-lock mechanism (not shown) can be provided for removable, rotatable retention of collar 114 on selector core 46. Outer sleeve 12 is slidably and non-rotatably mounted on the rearward end of selector core 46. Screwdriver 10B may be provided with a plurality of removable bit storage members 14B, each pre-loaded with a different selection of tool bits, thereby enabling the user to quickly adapt screwdriver 10B to different uses by interchangeably mounting different bit storage members thereon.

Figure 10:
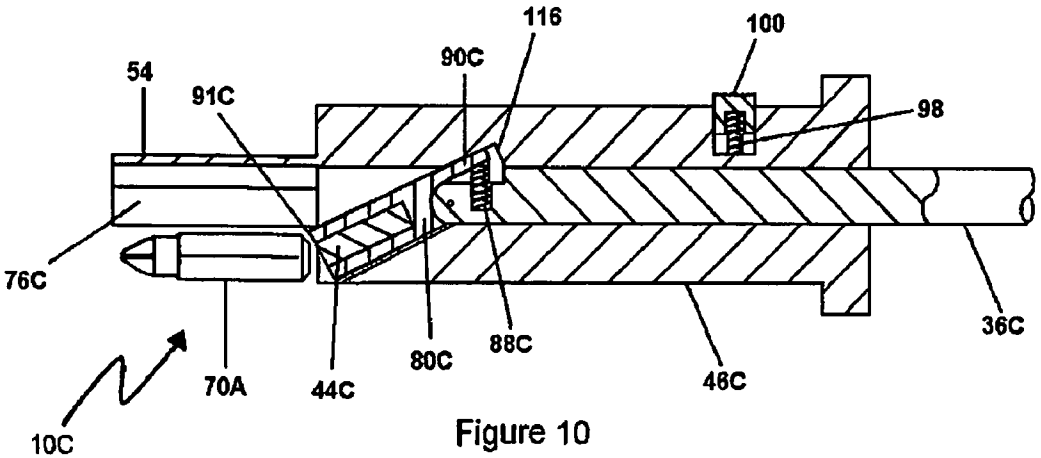
FIGS. 10 and 11 are cross-sectional side elevation views of a further alternate embodiment of the invention having an alternate magnetic lever arm.
Figure 11:
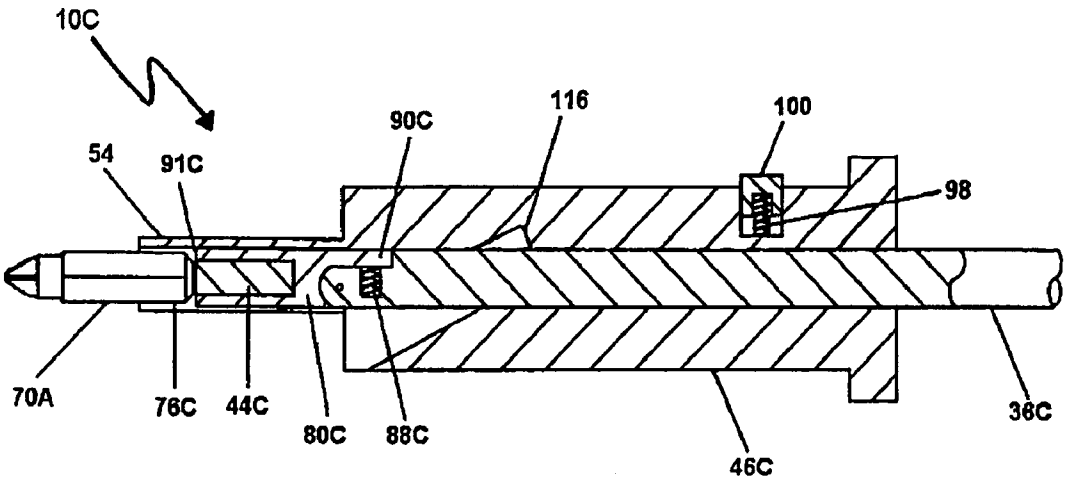

FIGS. 10 and 11 depict another alternate screwdriver 10C having an alternative magnetic lever arm. Functionally equivalent components which are common to the embodiments of FIGS. 1–5 and FIGS. 10 and 11 bear the same reference numerals and need not be further described. The suffix "C" is appended to reference numerals designating components of screwdriver 10C which correspond to components of screwdriver 10 bearing the same non-alphabetically suffixed reference numerals, but have a different structure. Magnetic lever arm 80C is pivotally mounted on push rod 36C and biased through bit changing slot 76C in selector core 46C by first spring 88C. Lever arm magnet 44C magnetically attracts to its forward end, a selected tool bit 70A in one of grooves 74. As push rod 36C is pushed forwardly through selector core 46C, a rearward end 90C of lever arm 80C is pushed inwardly by forward end of cavity 116 overcoming first spring 88C bias and pivoting forward end 91C and magnetically attracted tool bit 70A through bit changing slot 76C and into stem 54.

As will be apparent to those skilled in the art in the light of the foregoing disclosure, many alternations and modifications are possible in the practice of this invention without departing from the spirit or scope thereof. For example, instead of providing interleaved ridges and grooves on the inner sleeve's outer surface and on the outer sleeve's inner surface to determine the indexable positions of bit changing slot relative to the bit storage cavities; one could instead provide a radially outwardly extending pin on the inner sleeve's rearward end and a series of radially spaced longitudinally extending slots on the outer sleeve's inner surface; or, configure spring retainer 100 for locking engagement with the inner sleeve's inner surface except when push rod 36 is fully withdrawn. Instead of providing a separate selector core stem 54 and shaft 58 as in the embodiment of FIGS. 1–5, one could substitute a single integral (preferably steel) shaft. One could also replace outer sleeve 12 with a simple knob or other suitable hand grip on the rearward end of push rod 36. Sleeves 12, 14 need not be telescopically slidable within one another; for example, in the embodiment of FIGS. 8–9, collar 114 need not be telescopically slidable within outer sleeve 12—sleeve 12 is slidably and non-rotatably mounted on the rearward end of selector core 46. The scope of the invention is to be construed in accordance with the substance defined by the following claims.

What is claimed is:

1. A screwdriver, comprising:

(a) an apertured core;

(b) a bit storage member rotatable with respect to said core;

(c) a plurality of bit storage spaces provided within said bit storage member;

(d) a push rod slidably movable through said core;

(e) a push rod having a means for magnetically attracting on a forward end of said push rod;

(f) a hand grip on a rearward end of said push rod;

(g) a magnetic bit changing arm movable toward a selected one of said bit storage spaces;

(h) an apertured shaft extending from a forward end of said core and in coaxial alignment with said push rod;

wherein:

(i) said push rod is slidably movable through said core and through said bit storage member between extended and refracted positions;

(ii) when said push rod is in said extended position:

(1) said means for magnetically attracting is located rearwardly of said bit storage spaces;

(2) said core is rotatable with respect to said bit storage member to position said bit changing arm adjacent said selected one of said bit storage spaces;

(3) said bit changing arm is extended toward said selected one of said bit storage spaces, magnetically attracting to said bit changing arm a tool bit located in said selected one of said bit storage spaces;

(iii) during movement of said push rod from said extended position into said retracted position:

(1) said core is not rotatable with respect to said bit storage member;

(2) said push rod pushes said bit changing arm and said magnetically attracted tool bit away from said selected one of said bit storage spaces and into coaxial alignment with said shaft;

(3) said push rod and said means for magnetically attracting is pushed forwardly toward a rearward end of said magnetically attracted tool bit, magnetically attracting said tool bit onto said push rod; and, (4) said push rod is pushed forwardly, pushing said tool bit forwardly into said shaft until said tool bit protrudes through an open forward end of said shaft.

2. A screwdriver as defined in claim 1, further comprising a bit changing slot in said core.

3. A screwdriver as defined in claim 2, wherein during movement of said push rod from said retracted position into said extended position said means for magnetically attracting magnetically retains said tool bit on said forward end of said push rod as said push rod is pulled rearwardly, thereby pulling said tool bit rearwardly through said shaft to position said tool bit adjacent said bit changing slot and said selected one of said bit storage spaces.

4. A screwdriver as defined in claim 3, wherein said bit changing arm further comprises a magnetic lever arm pivotally coupled to said core and biased toward said bit changing slot.

5. A screwdriver as defined in claim 4, further comprising a first spring coupled between said lever arm and said core to bias said lever arm toward and through said bit changing slot and wherein said movement of said push rod from said extended position into said retracted position pushes said forward end of said push rod against said lever arm, overcoming said first spring bias.

6. A screwdriver as defined in claim 5, wherein said movement of said push rod from said retracted position into said extended position withdraws said push rod from said lever arm, whereupon said first spring biases said lever arm toward and through said bit changing slot, sweeping said tool bit into said selected one of said bit storage spaces.

7. A screwdriver as defined in claim 6, wherein:
(a) each of said bit storage spaces further comprises a bit storage cavity in a forward end of said bit storage member; and,
(b) said core has a forward face forming a tool bit base support for said bit storage cavities.

8. A screwdriver as defined in claim 7, wherein:
(a) said core further comprises a forwardly projecting stem; and,
(b) said core aperture has a cross section smaller than a largest cross section of said tool bit.

9. A screwdriver as defined in claim 2, wherein:
(a) said core further comprises a forwardly projecting stem;
(b) said stein and said shaft are hexagonally apertured and are hexagonally aligned whenever said bit changing slot is positioned adjacent one of said bit storage cavities; and,
(c) said tool bit has a hexagonal cross section smaller than the hexagonal cross section of either one of said stem or said shaft apertures.

10. A screwdriver as defined in claim 1, wherein:
(a) said hand grip further comprises an outer sleeve; and,
(b) said bit storage member further comprises an inner sleeve telescopically slidable within said outer sleeve.

11. A screwdriver as defined in claim 10, further comprising a core retainer to rotatably retain said core in said inner sleeve.

12. A screwdriver as defined in claim 11, further comprising:
(a) a forwardly tapered region on a central forward portion of said push rod;
(b) a atop member; and,
(c) a second spring coupled between an inner surface of said inner sleeve and said stop member to bias said stop member toward said push rod.

13. A screwdriver as defined in claim 12, wherein said movement of said push rod from said retracted position into said extended position positions said tapered region adjacent said stop member, whereupon said second spring biases said stop member into said tapered region, thereby preventing further rearward movement of said push rod.

14. A screwdriver as defined in claim 13, wherein during said movement of said push rod from said extended position into said retracted position, said tapered region contacts said stop member, overcomes said second spring bias and moves said stop member away from said push rod, thereby allowing forward movement of said push rod.

15. A screwdriver as defined in claim 14, further comprising a retainer positioned between said second spring and said inner surface of said inner sleeve, and wherein during rotation of said core wit respect to said bit storage member, said second spring biases said retainer into one of a plurality of grooves formed in said inner surface of said inner sleeve.

16. A screwdriver as defined in claim 10, further comprising:
(a) a first plurality of longitudinally extending ridges and grooves alternately interleaved on an outer surface of said inner sleeve; and,
(b) a second plurality of longitudinally extending ridges and grooves alternately interleaved on an inner surface of said outer sleeve;
wherein:
(i) said first plurality ridges are sized and shaped for slidable longitudinal movement along said second plurality grooves; and,
(ii) said second plurality ridges are sized and shaped for slidable longitudinal movement along said first plurality grooves.

17. A screwdriver as defined in claim 16, said core having a rearward base portion.

18. A screwdriver as defined in claim 17, further comprising a third plurality of longitudinally extending ridges and grooves alternately interleaved on an outer surface of said base portion,
wherein:
(i) said third plurality ridges are sized and shaped for slidable longitudinal movement along said second plurality grooves; and,
(ii) said second plurality ridges are sized and shaped for slidable longitudinal movement along said third plurality grooves.

19. A screwdriver as defined in claim 18, wherein said first, said second and said third plurality ridges and grooves are mutually aligned such that whenever said outer sleeve is telescopically slidably movable with respect to said inner sleeve said bit changing slot is aligned with one of said bit storage spaces.

20. A screwdriver as defined in claim 10, wherein said shaft is non-rotatably retained on the forward end of said inner sleeve.

21. A screwdriver as defined in claim 10, wherein said shaft is rotatably retained on the forward end of said inner sleeve with a reversible one-way ratchet.

22. A screwdriver as defined in claim 1, further comprising a forwardly projecting stem on said core, said stem having a forward rim for self centering engagement within a rearward base on said shaft.

23. A screwdriver as defined in claim 1, further comprising a rearwardly protruding shank on said rearward end of said hand grip.

24. A screwdriver as defined in claim 23, wherein said push rod rearward end is recessed and fastened within said shank.

25. A screwdriver, comprising:
(a) an apertured core;
(b) a bit storage member rotatable with respect to said core;
(c) a plurality of bit storage spaces provided within said bit storage member;
(d) a push rod slidably movable through said core;
(e) said push rod having a means for magnetically attracting on a forward end of said push rod;
(f) a hand grip on a rearward end of said push rod;
(g) a bit changing arm movable toward a selected one of said bit storage spaces;
(h) an apertured shaft extending from a forward end of said core and in coaxial alignment with said push rod;
wherein:
(i) said push rod is slidably movable through said core and through said bit storage member between extended and retracted positions;
(ii) when said push rod is in said extended position:
(1) said means for magnetically attracting is located rearwardly of said bit storage spaces;
(2) said core is rotatable with respect to said bit storage member to position said bit changing arm adjacent said selected one of said bit storage spaces;
(3) said means for magnetically attracting is pushed forwardly toward a rearward end of said tool bit, magnetically attracting said tool bit onto said means for magnetically attracting; and, (4) said bit changing arm is extended toward said selected one of said bit storage spaces, releasably mounting to said bit changing arm a tool bit located in said selected cue of said bit storage spaces;

(iii) during movement of said push rod from said extended position into said retracted position:

(1) said core is not rotatable with respect to said bit storage member;

(2) said push rod pushes said bit changing arm and said releasably mounted tool bit away from said selected one of said bit storage spaces and into coaxial alignment with said shaft;

(3) said push rod is pushed forwardly, pushing said tool bit forwardly into said shaft until said tool bit protrudes through an open forward end of said shaft.

26. A screwdriver as defined in claim 25, further comprising a bit changing slot in said core.

27. A screwdriver as defined in claim 26, wherein during movement of said push rod from said retracted position into said extended position said push rod magnetically retains said tool bit on said forward end of said push rod as said push rod is pulled rearwardly, thereby pulling said tool bit rearwardly through said shaft to position said tool bit adjacent said bit changing slot and said selected one of said bit storage spaces.

28. A screwdriver as defined in claim 27, wherein said bit changing arm further comprises a lever arm biased toward said bit changing slot.

29. A screwdriver as defined in claim 28, further comprising a first spring to bias said lever arm toward and through said bit changing slot and wherein said movement of said push rod from said extended position into said retracted position pushes said push rod against said lever arm, overcoming said first spring bias.

30. A screwdriver as defined in claim 29, whereupon said movement of said push rod from said refracted position into said extended position, said first spring biases said lever arm toward and through said bit changing slot, sweeping said tool bit into said selected one of said bit storage spaces.

31. A screwdriver as defined in claim 30, wherein:

(a) each of said bit storage spaces further comprises a bit storage cavity in a forward end of said bit storage member; and, (b) said core has a forward face forming a tool bit base support for said bit storage cavities.

32. A screwdriver as defined in claim 31, wherein:

(a) said core further comprises a forwardly projecting stem; and, (i) said core aperture has a cross section smaller than a largest cross section of said tool bit.

33. A screwdriver as defined in claim 26, wherein:

(a) said core further comprises a forwardly projecting stem;

(b) said stem and said shaft are hexagonally apertured and are hexagonally aligned whenever said bit changing slot is positioned adjacent one of said bit storage cavities; and, (c) said tool bit has a hexagonal cross section smaller than the hexagonal cross section of either one of said stem or said shaft apertures.

34. A screwdriver as defined in claim 25, wherein:

(a) said hand grip further comprises an outer sleeve; and, (b) said bit storage member further comprises an inner sleeve telescopically slidable within said outer sleeve.

35. A screwdriver as defined in claim 34, further comprising a core retainer to rotatably retain said core in said inner sleeve.

36. A screwdriver as defined in claim 35, further comprising:

(a) a forwardly tapered region on a central forward portion of said push rod;

(b) a stop member; and, (c) a second spring coupled between an inner surface of said inner sleeve and said stop member to bias said stop member toward said push rod.

37. A screwdriver as defined in claim 36, wherein, said movement of said push rod from said refracted position into said extended position positions said tapered region adjacent said stop member, whereupon said second spring biases said stop member into said tapered region, thereby preventing further rearward movement of said push rod.

38. A screwdriver as defined in claim 37, wherein during said movement of said push rod from said extended position into said retracted position, said tapered region contacts said stop member, overcomes said second spring bias and moves said stop member away from said push rod, thereby allowing forward movement of said push rod.

39. A screwdriver as defined in claim 38, further comprising a retainer positioned between said second spring and said inner surface of said inner sleeve, and wherein during rotation of said core with respect to said bit storage member, said second spring biases said retainer into one of a plurality of grooves formed in said inner surface of said inner sleeve.

40. A screwdriver as defined in claim 34, further comprising:

(a) a first plurality of longitudinally extending ridges and grooves alternately interleaved on an outer surface of said inner sleeve;

(b) a second plurality of longitudinally extending ridges and grooves alternately interleaved on an inner surface of said outer sleeve;

wherein:

(i) said first plurality ridges are sized and shaped for slidable longitudinal movement along said second plurality grooves; and, (ii) said second plurality ridges are sized and shaped for slidable longitudinal movement along said first plurality grooves.

41. A screwdriver as defined in claim 40, said core having a rearward base portion.

42. A screwdriver as defined in claim 41, further comprising a third plurality of longitudinally extending ridges and grooves alternately interleaved on an outer surface of said base portion, wherein:

(i) said third plurality ridges are sized and shaped for slidable longitudinal movement along said second plurality grooves; and, (ii) said second plurality ridges are sized and shaped for slidable longitudinal movement along said third plurality grooves.

43. A screwdriver as defined in claim 42, wherein said first, said second and said third plurality ridges and grooves are mutually aligned such that whenever said outer sleeve is telescopically slidably movable wit respect to said inner sleeve said bit changing slot is aligned with one of said bit storage spaces.

44. A screwdriver as defined in claim 34, wherein said shaft is non-rotatably retained on the forward end of said inner sleeve.

45. A screwdriver as defined in claim 34, wherein said shaft is rotatably retained on the forward end of said inner sleeve with a reversible one-way ratchet.

46. A screwdriver as defined in claim 25, further comprising a forwardly projecting stem on said core, said stem having a forward rim for self-centering engagement within a rearward base on said shaft.

47. A screwdriver as defined in claim 25, further comprising a rearwardly protruding shank on said rearward end of said hand grip.

48. A screwdriver as defined in claim 47, wherein said push rod rearward cud is recessed and fastened within said shank.

49. A screwdriver as defined in claim 48 wherein said bit changing arm is magnetic and wherein said releasable mounting is magnetic, and wherein said means for magnetically attracting is a magnet mounted on said push rod.

50. A screwdriver as defined in claim 25 wherein said bit changing arm is magnetic and wherein said releasable mounting is magnetic, and wherein said means for magnetically attracting is a magnet mounted on said push rod.

* * * * *